US007789812B2

(12) United States Patent
Anderson et al.

(10) Patent No.: US 7,789,812 B2
(45) Date of Patent: Sep. 7, 2010

(54) ROPE CLIMBING EXERCISE APPARATUS

(75) Inventors: Joseph M. Anderson, 4900 Indian Hill Rd., Lewiston, NY (US) 14092; Steven M. Nichols, Hamburg, NY (US)

(73) Assignee: Joseph M. Anderson, Lewiston, NY (US)

( * ) Notice: Subject to any disclaimer, the term of this patent is extended or adjusted under 35 U.S.C. 154(b) by 52 days.

(21) Appl. No.: 12/286,432

(22) Filed: Sep. 30, 2008

(65) Prior Publication Data

US 2010/0081550 A1 Apr. 1, 2010

(51) Int. Cl.
*A63B 21/00* (2006.01)

(52) U.S. Cl. ..... 482/95; 482/196

(58) Field of Classification Search ..... 482/195, 482/196, 148, 121, 908
See application file for complete search history.

(56) References Cited

U.S. PATENT DOCUMENTS

| | | | | |
|---|---|---|---|---|
| 3,782,718 | A | 1/1974 | Saylor | |
| 5,076,574 | A | 12/1991 | Johnson, Jr. | |
| 5,176,377 | A * | 1/1993 | Wilkinson | 482/120 |
| 5,620,403 | A * | 4/1997 | Lundin | 482/96 |
| 5,944,641 | A * | 8/1999 | Habing | 482/96 |
| 6,921,355 | B2 * | 7/2005 | Campanaro et al. | 482/95 |
| 7,018,323 | B1 | 3/2006 | Reynolds et al. | |
| 7,086,991 | B2 | 8/2006 | Williams et al. | |
| 7,172,538 | B2 | 2/2007 | Keiser | |

* cited by examiner

*Primary Examiner*—Jerome Donnelly
(74) *Attorney, Agent, or Firm*—Phillips Lytle LLP

(57) ABSTRACT

A rope climbing apparatus (15) comprising a frame (16), a seat (18) supported by the frame and adapted to move relative to the frame from a first position (19) to an elevated second position (20), a lower pulley assembly (21) connected to the seat, an upper pulley assembly (22) connected to the frame, a rope (23) extending between the lower pulley assembly and the upper pulley assembly and having a rope climbing portion (24) graspable by a user (25) when the user is seated on the seat, and the rope, the seat, the lower pulley assembly and the upper pulley assembly configured and arranged such that a downward force (26) on the rope climbing portion of the rope causes an upward force (28) on the seat. The downward force on the rope climbing portion may result in an upward force on the seat at a mechanical advantage provided by the lower pulley assembly and the upper pulley assembly, and the mechanical advantage may be four. The rope may comprise a first end portion (29) connected to the seat and the rope climbing portion may comprise a second end portion (30) terminating within grasp of the user when the user is seated on the seat. The first end portion of the rope may be connected to the seat via the lower pulley assembly, such that the first end portion of the rope is connected directly to the lower pulley assembly.

11 Claims, 11 Drawing Sheets

ROPE CLIMBING EXERCISE APPARATUS

TECHNICAL FIELD

The present invention relates to exercise machines, and more particularly to a rope climbing exercise apparatus.

BACKGROUND ART

Certain rope climbing devices are known in the prior art. For example, U.S. Pat. Nos. 3,782,718, 5,076,574, 7,018,323 and 7,086,991 disclose continuous rope type climbing machines.

DISCLOSURE OF THE INVENTION

With parenthetical reference to corresponding parts, portions or surfaces of the disclosed embodiment, merely for the purposes of illustration and not by way of limitation, the present invention provides a rope climbing apparatus (15) comprising a frame (16), a seat (18) supported by the frame and adapted to move relative to the frame from a first position (19) to an elevated second position (20), a lower pulley assembly (21) connected to the seat, an upper pulley assembly (22) connected to the frame, a rope (23) extending between the lower pulley assembly and the upper pulley assembly and having a rope climbing portion (24) graspable by a user (25) when the user is seated on the seat, and the rope, the seat, the lower pulley assembly and the upper pulley assembly configured and arranged such that a downward force (26) on the rope climbing portion of the rope causes an upward force (28) on the seat.

The downward force on the rope climbing portion may result in an upward force on the seat at a mechanical advantage provided by the lower pulley assembly and the upper pulley assembly, and the mechanical advantage may be four. The rope may comprise a first end portion (29) connected to the seat and the rope climbing portion may comprise a second end portion (30) terminating within grasp of the user when the user is seated on the seat. The first end portion of the rope may be connected to the seat via the lower pulley assembly, such that the first end portion of the rope is connected directly to the lower pulley assembly.

The lower pulley assembly may comprise two pulleys (31, 32) rotatable about a lower axis of rotation (33), the upper pulley assembly may comprise three pulleys (34, 35, 36) rotatable about an upper axis of rotation (37) and the rope may extend between the pulleys in the upper pulley assembly and the pulleys in the lower pulley assembly to form a compound pulley system. The rope may comprise a first end portion connected to the lower pulley assembly and may extend from the first end portion up and over the first pulley in the upper pulley assembly, down and under the first pulley in the lower pulley assembly, up and over the second pulley in the upper pulley assembly, down and under the second pulley in the lower pulley assembly, and up and over the third pulley in the upper pulley assembly. The rope may further extend over a sixth pulley above the seat and terminate at a second end portion within grasp of the user when the user is seated on the seat.

The rope climbing apparatus may further comprise a seat descent control (39) configured and arranged to control the rate of descent of the seat from the second elevated position to the first position. The seat descent control may comprise a tube (40) housing a piston (41), the piston movable within the tube between a first position (45) and an elevated second position (46), a control rope (48) connected to the movable piston at a first end portion (49) and extending from the first end down and under a control pulley (53) connected to the seat and connecting to the frame at a second end portion (50), the control pulley, the tube, the piston and the control rope configured and arranged such that the piston moves from the first position (45) to the elevated second position (46) when the seat moves from the elevated second position (20) to the first position (19), and whereby resistance to the piston moving within the tube from the first position to the elevated second position limits the rate of descent of the seat from the second elevated position to the first position.

The rope climbing apparatus may further comprise a resistance mechanism (55) in mechanical communication with the rope for selectively providing resistance to movement of the rope. The resistance mechanism may comprise a handle (59) connected to a compression member (56) adapted to frictionally engage the rope, the handle and the compression member configured and arranged to selectively restrict movement of the rope past the compression member.

Accordingly, an object is to provide a rope climbing exercise apparatus which more closely simulates the sensation of climbing a rope.

Another object is to provide a rope climbing apparatus which is compact and will occupy a relatively small area in a conventional gym or workout facility.

Another object is to provide a rope climbing apparatus which selectively regulates the rate of movement of certain components.

These and other objects and advantages will become apparent from the foregoing and ongoing written specification, the drawings, and the claims.

DESCRIPTION OF PREFERRED EMBODIMENTS

Figure 1:
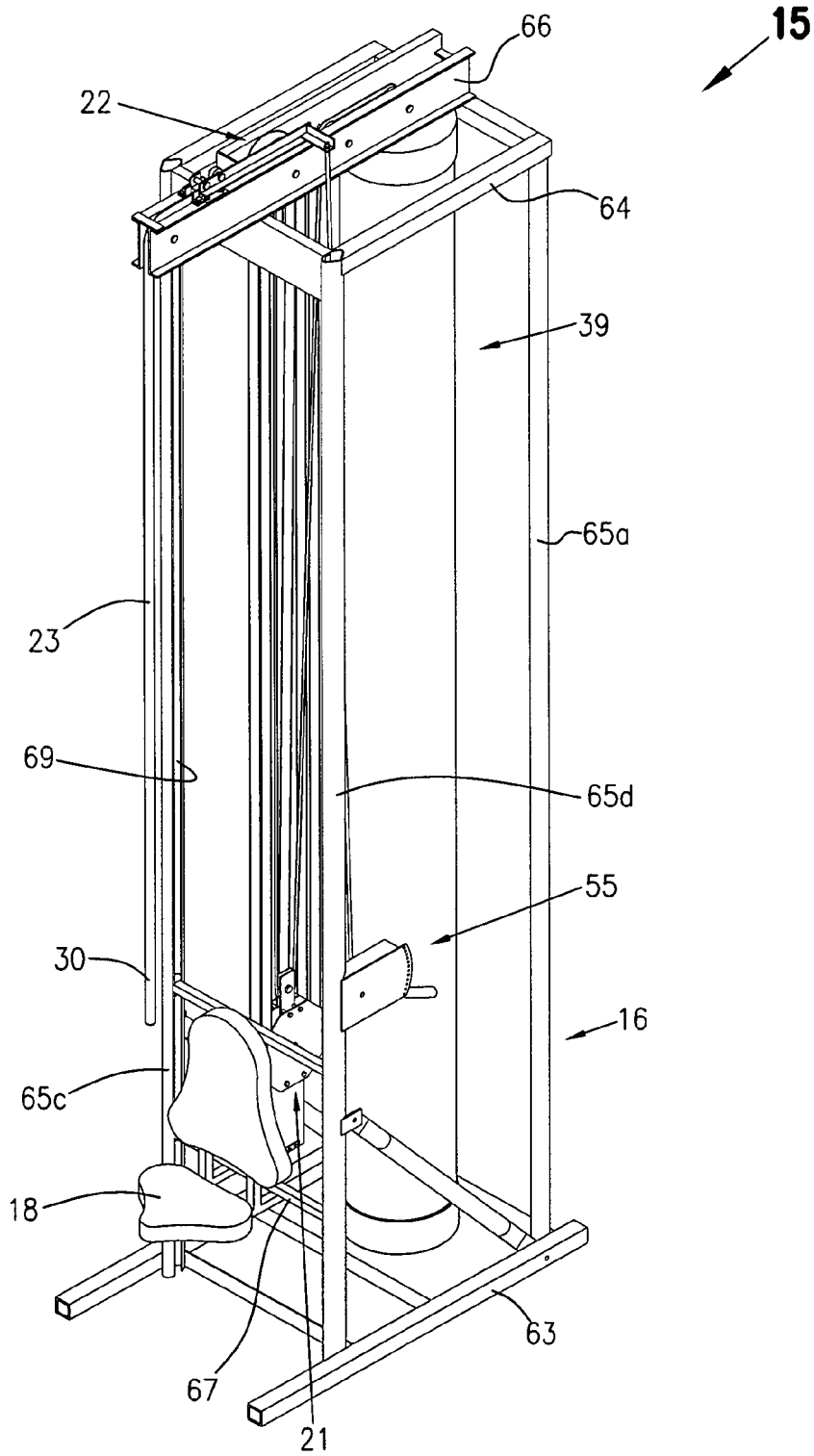
FIG. 1 is a perspective view of a first embodiment of the rope climbing apparatus.
Figure 2:
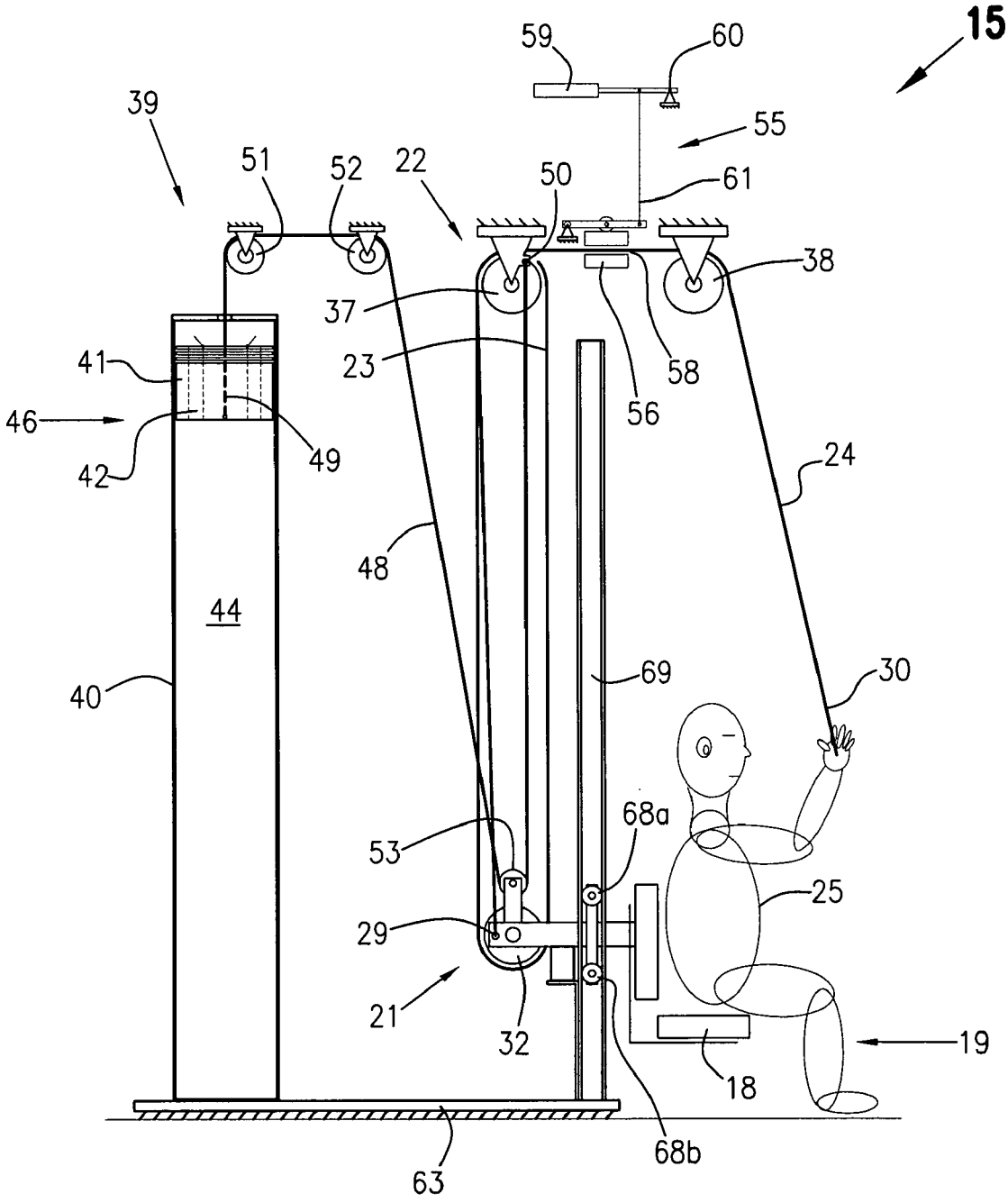
FIG. 2 is a schematic view of the rope climbing apparatus shown in FIG. 1 with the seat occupied by a user.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring now to the drawing and, more particularly, to FIG. 1 thereof, this invention provides a rope climbing apparatus, of which a first embodiment is generally indicated at 15. As shown in FIG. 1, embodiment 15 generally includes frame 16 supporting seat 18, lower pulley assembly 21 fixably connected to seat 18, upper pulley assembly 22 fixably connected to frame 16, rope 23 extending between lower pulley assembly 21 and upper pulley assembly 22 and having end portion 29 connected to lower pulley assembly 21 and climbing portion 24 graspable by user 25 when user 25 is sitting on seat 18, a seat descent control mechanism 39 for controlling the rate of descent of seat 18 from elevated position 20 to resting position 19, and rope resistance mechanism 55 in mechanical communication with rope 23 for selectively providing resistance to movement of rope 23 by user 25.

As shown in FIGS. 1 and 8-11, frame 16 is formed of rigid metallic material, such as steel, and provides a support structure to maintain and support the various components of apparatus 15. Frame 16 is dimensioned so that it does not take up much surface area on the floor and generally includes horizontally oriented base frame element 63 and upper horizontally oriented frame element 64 supported above base element 63 by four vertically extending members 65*a-d*. Upper frame element 64 supports horizontally extending member 66, which is cantilevered to extend about twelve feet over seat 18 when seat 18 is in its resting position. Additional cross members and elbows are employed to add dimensional stability to frame 16.

As shown in FIGS. 2-11, seat 18 is in slidable engagement with frame 16 such that seat 18 moves vertically relative to frame 16 from resting position 19 to elevated position 20. In this embodiment, seat 18 is supported by vertically oriented seat frame 67, which includes two horizontally extending cross-members with rollers 68*a-d* on each end. Vertical members 65*c* and 65*d* of frame 16 include guide channels 69*a* and 69*b*, respectively, configured to receive rollers 68*a*/68*b* and 68*c*/68*d*, respectively, such that seat 18 will roll up and down in tracks 69 between resting position 19 and raised position 20.

Figure 10:
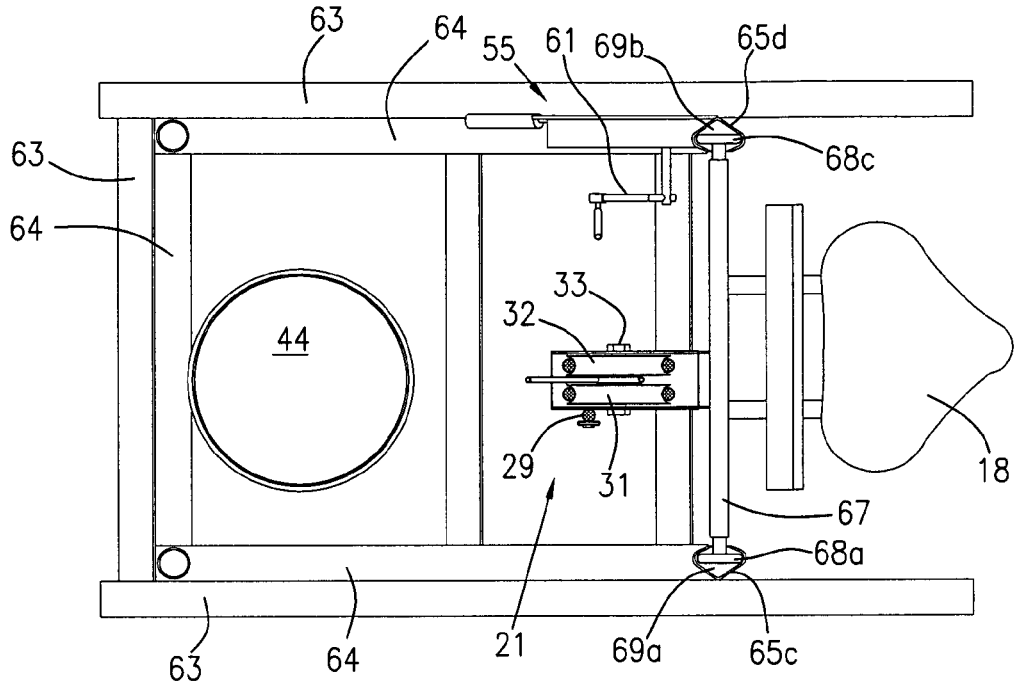
FIG. 10 is a horizontal sectional view of the rope climbing apparatus shown in FIG. 8, taken generally on line 10-10 of FIG. 8.

As shown in FIGS. 1-11, lower pulley assembly 21 is connected to seat frame element 67 opposite to seat 18. Thus, lower pulley assembly 21 is connected to seat 18 and moves vertically with seat 18 from resting position 19 to elevated position 20. As shown in FIG. 10, lower pulley assembly 21 includes two side-by-side pulleys 31 and 32 which rotate on a common axis 33. One end 29 of rope 23 is attached to lower pulley assembly 21.

Figure 11:
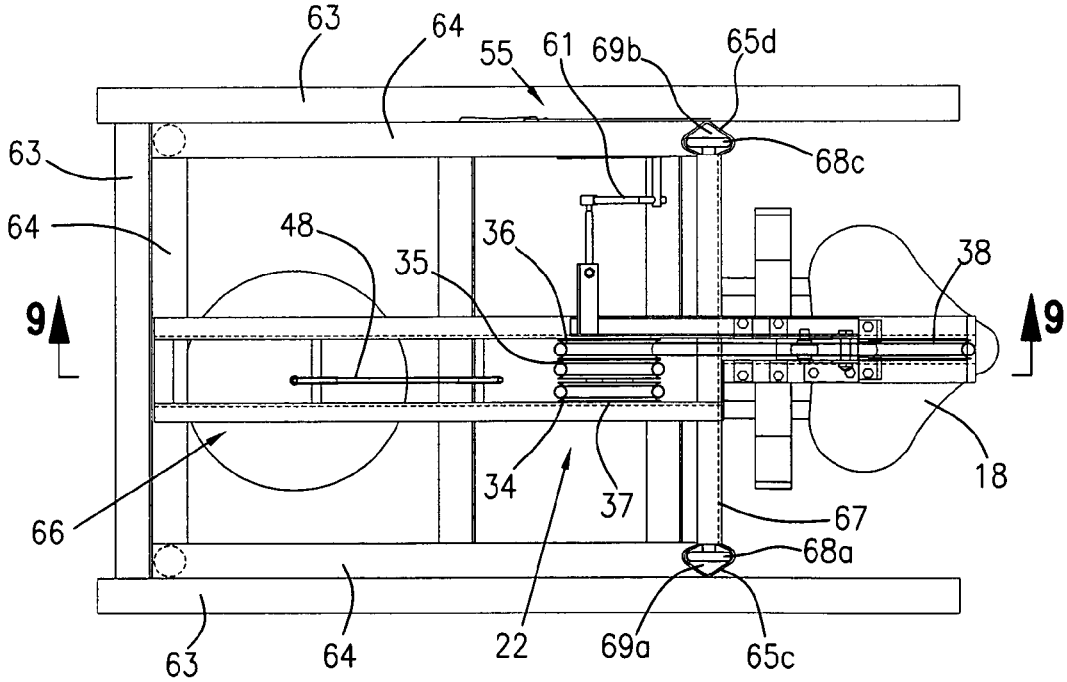
FIG. 11 is a top plan view of the rope climbing apparatus shown in FIG. 1.

As shown in FIG. 11, upper pulley assembly 22 is supported by member 66 directly above lower pulley assembly 21 and includes three side-by-side pulleys 34, 35 and 36 that rotate on a common axis of rotation 37. Upper pulley assembly 22 is fixed to member 66 and does not move with movement of seat 18.

As shown in FIGS. 1-11, rope 23 loops between lower pulley assembly 21 and upper pulley assembly 22 to form a compound pulley or block and tackle system. In particular, one end 29 of rope 23 is attached to lower pulley assembly 21. Rope 23 extends from attached end 29 up and over pulley 34 in assembly 22, down and under pulley 31 in assembly 21, up and over pulley 35 in assembly 22, down and under pulley 32 in assembly 21, and up and over pulley 36 in assembly 22. As shown in FIGS. 2-11, a sixth pulley 38 is provided at the cantilevered end of member 66 over seat 18 and rope 23 extends horizontally from pulley 37 over pulley 38 and hangs from pulley 38 down to terminate at second end 30 within reach or grasp of user 25 when user 25 is sitting on seat 18.

As shown in FIGS. 2-7, user 25 simulates rope climbing by sitting on seat 25 and applying with their arms a downward force 26 on the end portion 24 of rope 23 within grasp of user 25. If sufficient force is applied, given the mechanical advantage provided by the system, to overcome the weight of the user and subject components of the apparatus, upper pulleys 34, 35 and 36 and lower pulleys 31 and 32 are caused to rotate in tandem, raising lower pulley assembly 21 and seat 18 towards upper pulley assembly 22. Thus, the looping of rope 23 through upper and lower pulley assemblies 21 and 22 forms a compound pulley or block and tackle system that translates downward force on rope climbing portion 24 of rope 23 into an upward force on seat 18 at a mechanical advantage provided by pulley assemblies 21 and 22. In this embodiment, the mechanical advantage is four. However, different numbers of pulleys may be used in lower assembly 21 and upper assembly 22 as desired. For example, the lower pulley assembly may have just one pulley and the upper pulley assembly may have two pulleys, with the rope extending from the lower pulley assembly up and over a first pulley in the upper assembly, down and under the sole pulley in the lower pulley assembly, and up over the second pulley in the upper pulley assembly, before extending over and down from pulley 38.

Figure 3:
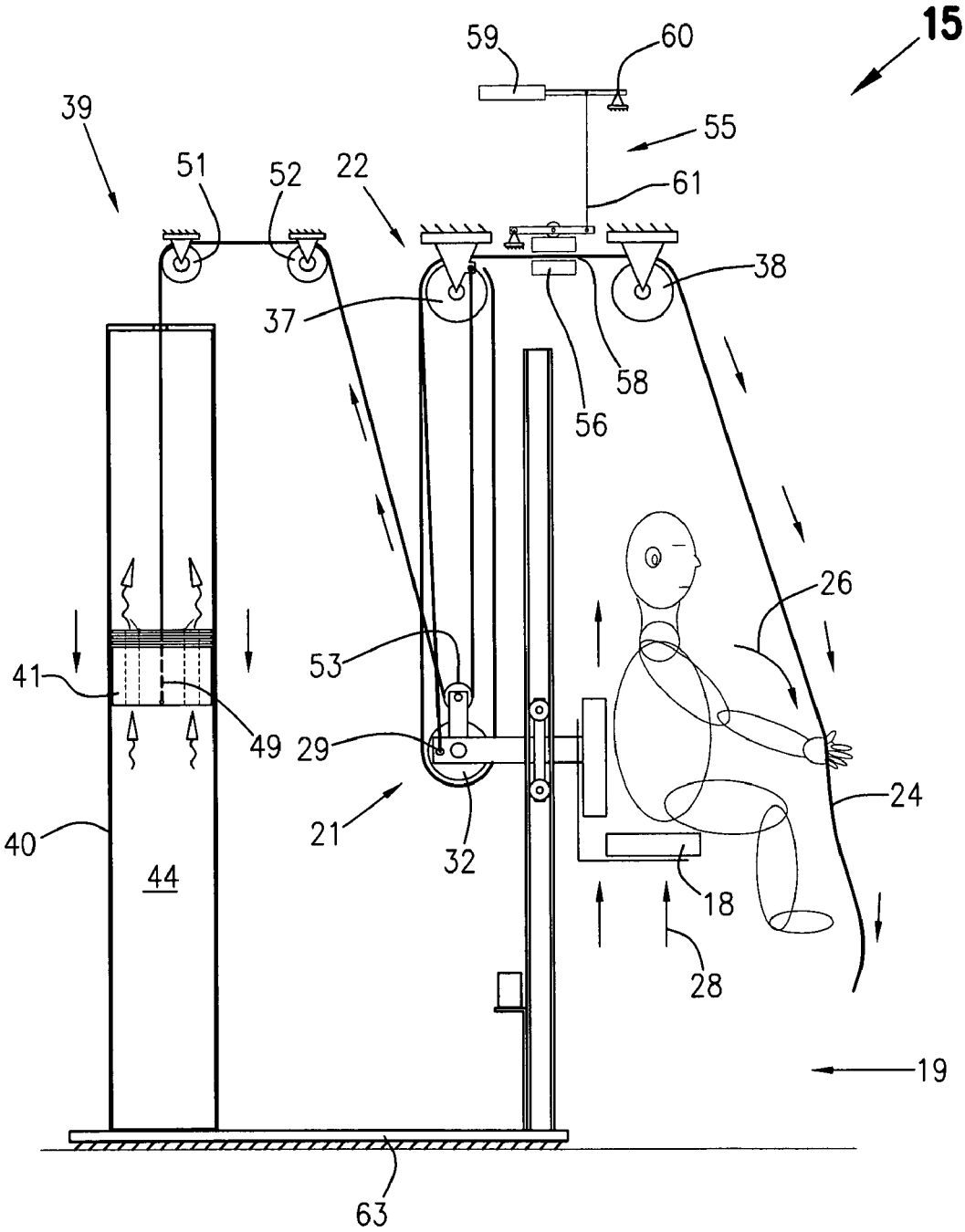
FIG. 3 is a schematic view of the rope climbing apparatus shown in FIG. 2 after application of a sufficient downward force on the rope by the user to raise the seat.
Figure 4:
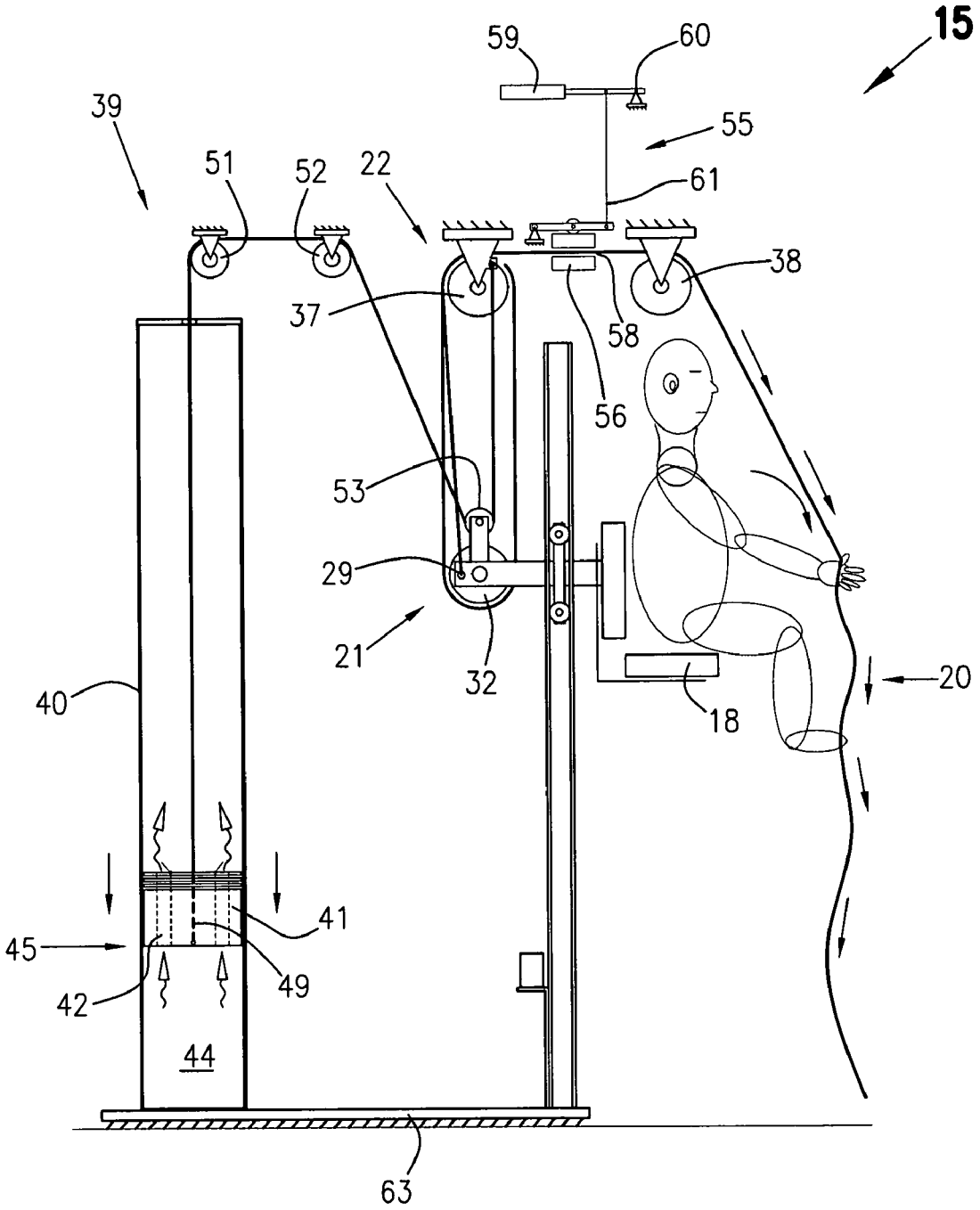
FIG. 4 is a schematic view of the rope climbing apparatus shown in FIG. 3 with the seat in a fully elevated position for the user.

Thus, as shown in FIG. 3-4, when user 25 simulates a hand-over-hand climbing exercise and pulls rope 23 down from pulley 38 with sufficient force, the length of rope between upper and lower assemblies 21 and 22 is reduced such that lower pulley assembly 21 moves vertical upwards towards upper pulley assembly 22, thereby raising seat 18 in tracks 69 of frame 16 from resting position 19 to elevated position 22. With this movement, the length of the portion 24 of rope 23 between pulley 38 and end 30 increases.

Figure 5:
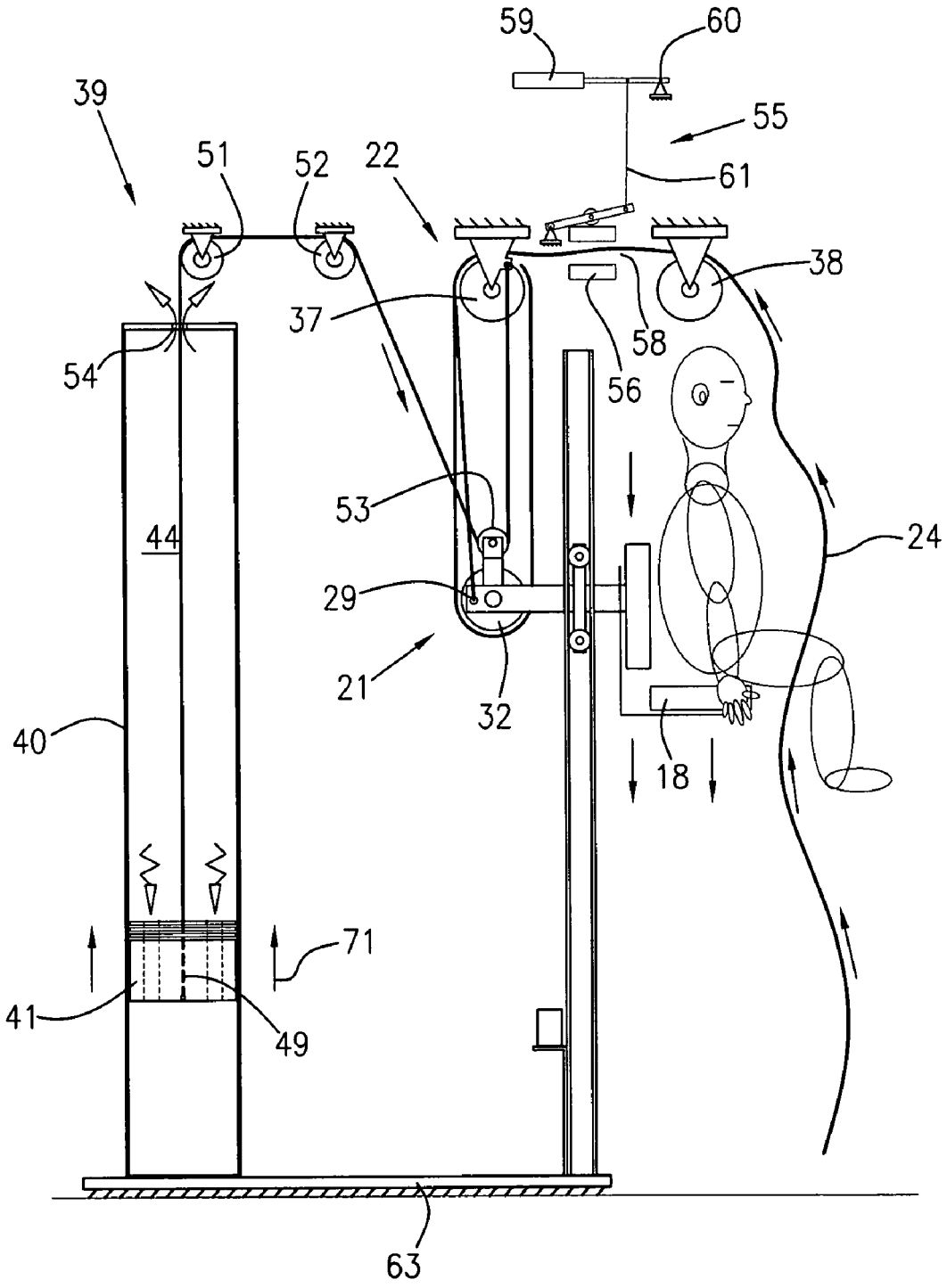
FIG. 5 is a schematic view of the rope climbing apparatus shown in FIG. 4 after the user has released the rope.
Figure 6:
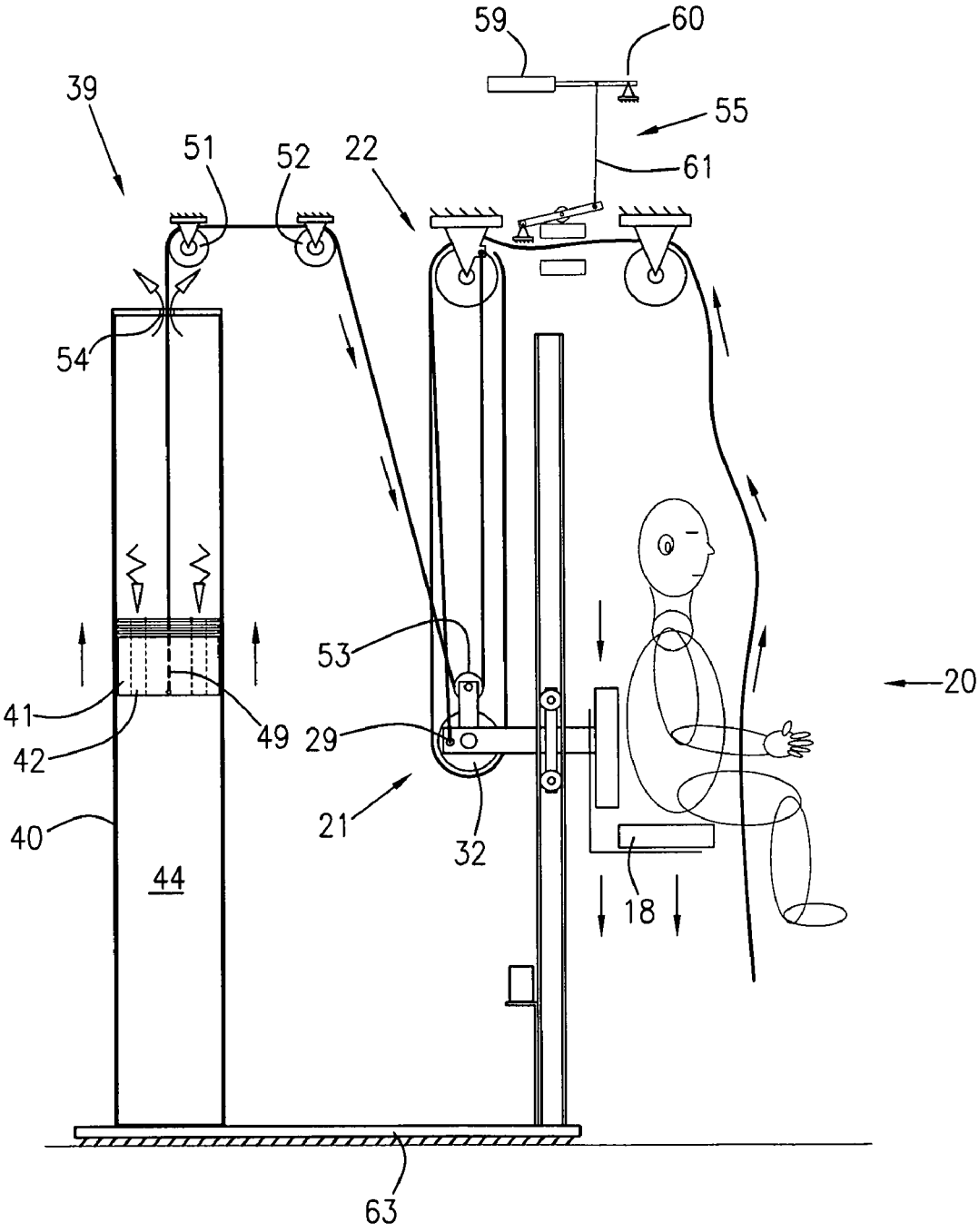
FIG. 6 is a schematic view of the rope climbing apparatus shown in FIG. 5 in a controlled descent.

As shown in FIGS. 5-6, once user 25 releases rope 23 and downward force is no longer applied to portion 24 of rope 23, the weight of user 25, seat 18 and lower assembly 21 will cause lower assembly 21 and seat 18 to descend and move away from upper pulley assembly 22 until seat 18 returns to resting position 19. Alternatively, user 25 may simulate a hand-over-handing rope descending exercise to lower themselves down to resting position 19.

Rope climbing apparatus 15 thereby allows user 25 to simulate ascending and descending rope climbing exercises, with ascending including hand-over-hand motions that exert a downward force 26 on rope 23 and that simulates rope climbing by lifting the user's body upwards on seat 18, and with descending including hand-under-hand motions that simulates rope descending by allow the user to lower themselves on seat 18. The user is able to simulate the rope ascending exercise until the user reaches member 16. In this regard, an upper bumper or stop may be inserted to keep upper wheels 68*a* and 68*c* from moving beyond a certain height in tracks 69 of members 68 so that user 25 can not raise seat 18 so high that their head hits or makes contact with the cantilevered portion of member 66. At this point, user 25 may then lower themselves by hand-under-hand motions in a downward manner. Typically user 25 is able to pull hand-over-hand on rope climbing portion 24 of rope 23 six to ten times before reaching the upper limit imposed by cantilever member 66, which provides good exercise for the arms and upper body of user 25.

As shown in FIGS. 2-7 and 12, descent control mechanism 39 is provided to control the rate of descent of seat 18 from elevated position 20 to resting position 19. If user 25 simply releases rope 23 when elevated, mechanism 39 prevents seat 18 and user 25 from falling suddenly to the ground. In this embodiment, descent control mechanism 39 includes cylindrical tube 40 sealed at both ends and having cylindrical chamber 44 therein. Cylindrical piston 41 is provided in chamber 44 and piston 41 moves vertically within tube 40 from lower position 45 to upper position 46. Wire cable 48 is attached at one end 49 to piston 41 and extends from end 49 up through channel 54 in the top of tube 40 and over pulley 51 supported by frame 16. Cable 48 then extends horizontally over pulley 52 supported by frame 16, down and under pulley 53 attached to lower pulley assembly 21, and then extends up to and connects at second end 50 to upper pulley assembly 22. As it is attached to lower assembly 21, pulley 53 rises and descends with movement of lower pulley assembly 21 and seat 18.

Figure 12:
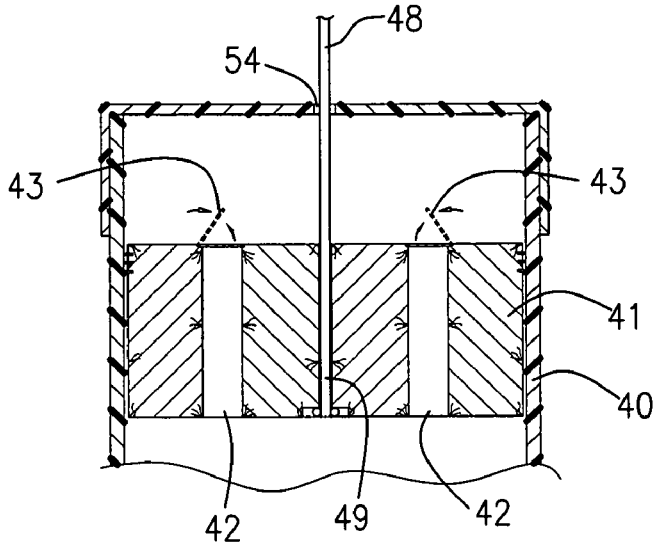
FIG. 12 is a detailed partial sectional view of the seat descent control shown in FIG. 1.

As shown in FIG. 12, piston 41 is provided with one or more channels 42. A one-way check valve 43 is provided in channel 42 such that air is able to flow relatively freely through channels 42 in one direction but is restricted from flowing through channels 42 in the reverse direction. In particular, valve 43 is orientated such that air is able to flow relatively freely through channels 42 when piston 41 is descending. However, air is restricted from flowing through channels 42 when piston 41 is ascending, and instead can only escape through channel 54.

Figure 7:
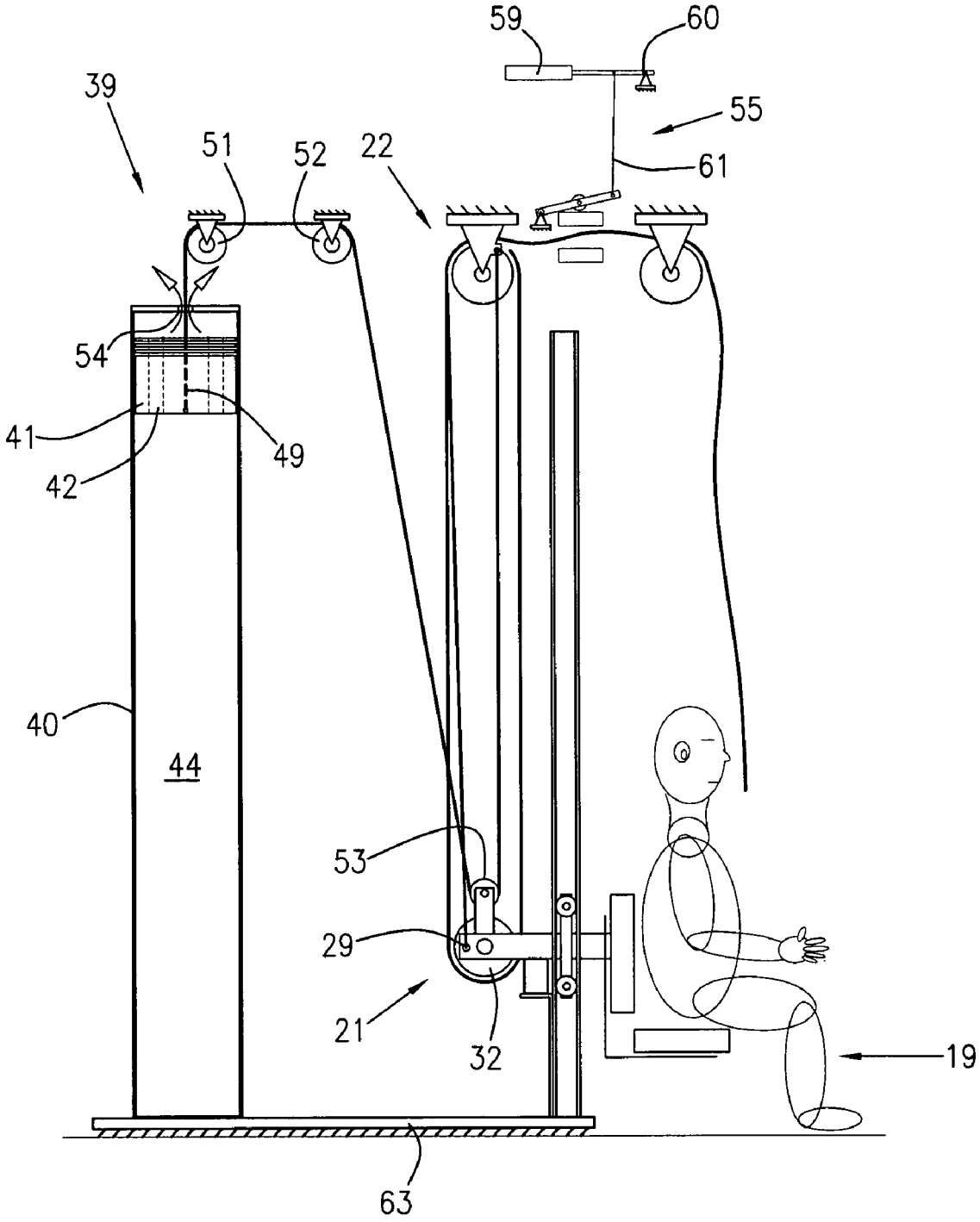
FIG. 7 is a schematic view of the rope climbing apparatus shown in FIG. 6 after the seat has returned to its resting position.
Figure 8:
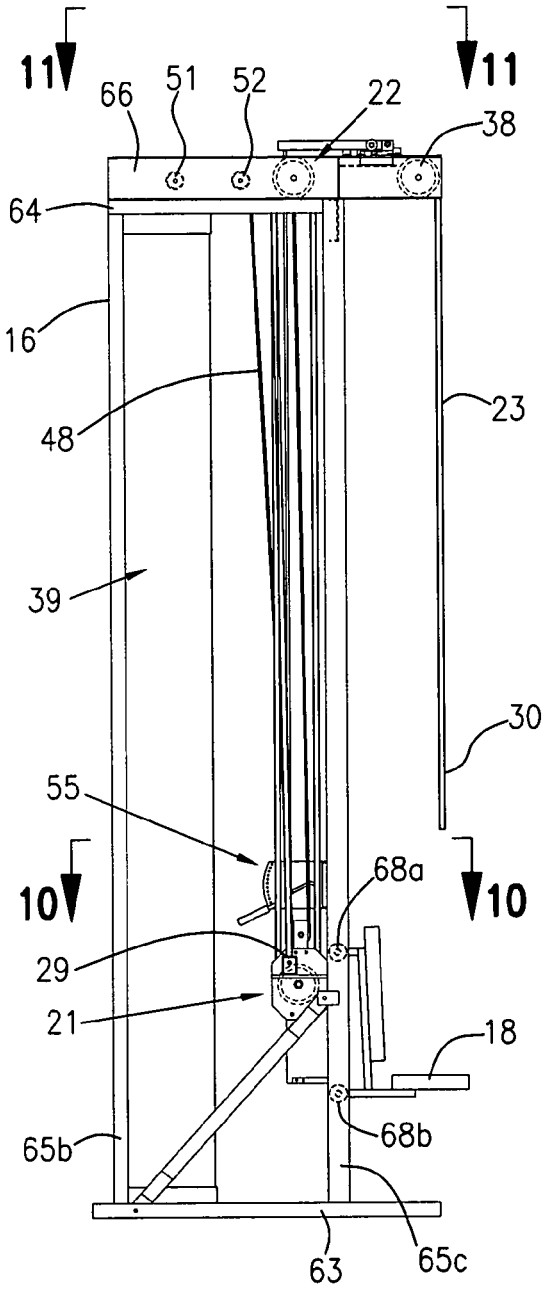
FIG. 8 is a left side view of the rope climbing apparatus shown in FIG. 1.
Figure 9:
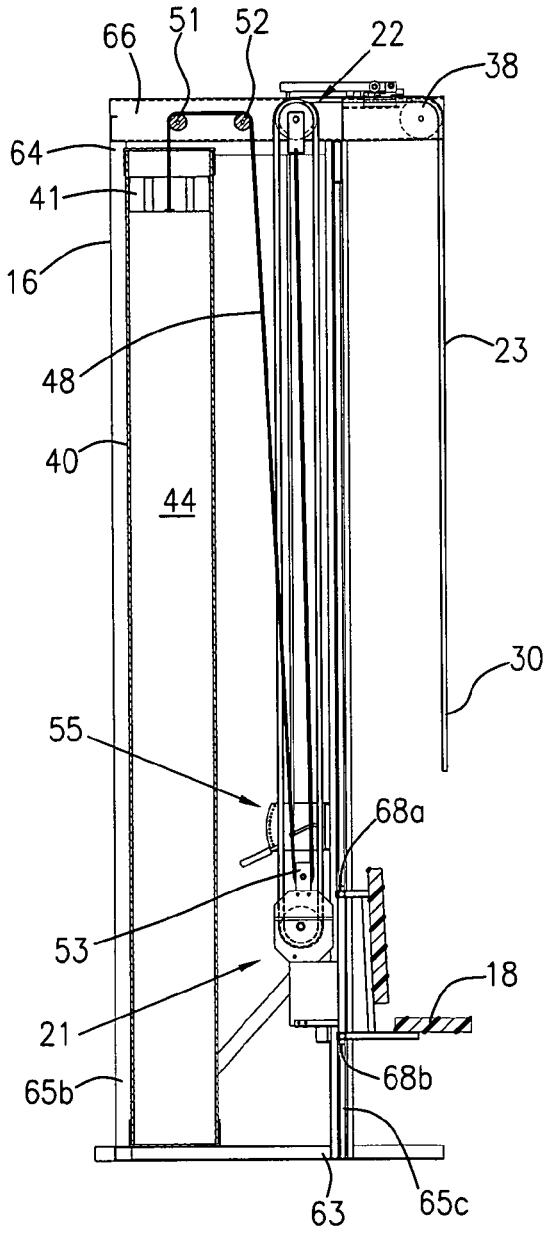
FIG. 9 is a partial longitudinal vertical sectional view of the rope climbing apparatus shown in FIG. 11, taken generally on line 9-9 of FIG. 11.

As shown in FIGS. 2-7, when user 25 pulls with sufficient force on rope climbing portion 24 of rope 23 to move seat 18 upwards from resting position 19, that required force being a function of the user's weight and the mechanical advantage provided by pulley assemblies 21 and 22, piston 41 will descend an equal distance from position 46. Because the air in chamber 44 is able to flow through channels 42 freely in this direction, as shown in FIG. 3-4, piston 41 does not provide any substantial resistance to the movement of seat 18 upwards. As shown in FIGS. 5-7, when user 25 releases rope 23, the weight of user 25 and assembly provides a downward force on lower assembly 21 and a corresponding upward force 71 on piston 41. However, upward force 71 is countered by air resistance in chamber 44. The amount of air resistance is a function of the diameter of channel 54 in the top of tube 40, and this diameter is provided such that the air resistance is sufficient to assure that seat 18 does not crash down to the ground if user 25 lets go of rope 23 entirely. Thus, when seat 18 rises, piston 41 in tube 40 is adapted to freely descend by a corresponding distance at the same speed. However, the air resistance on piston 41 limits the rate at which piston 41 will rise, and thereby limits the rate at which seat 18 descends.

Figure 13:
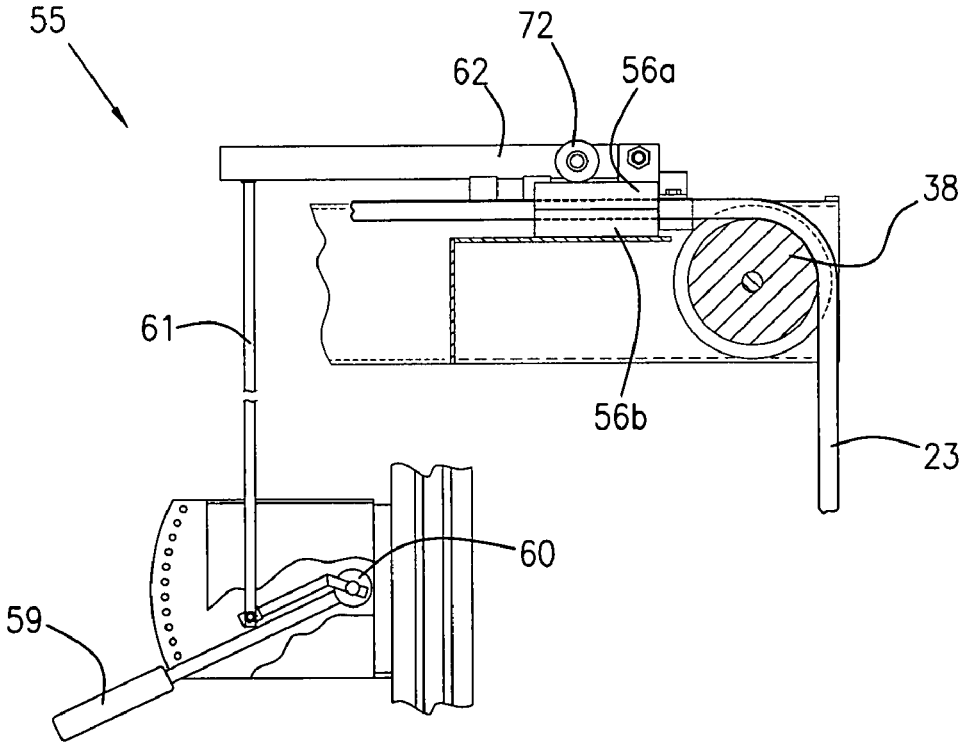
FIG. 13 is a partial sectional view of the rope resistance mechanism shown in FIG. 1 in a fully-restrictive position.
Figure 14:
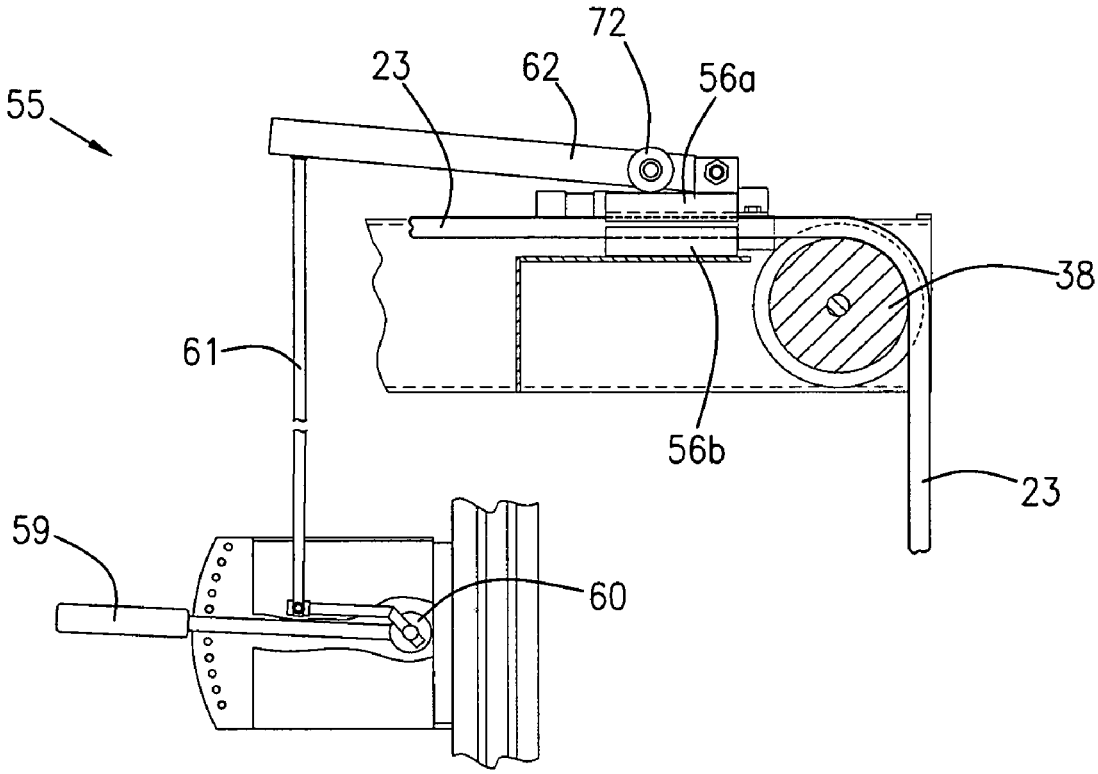
FIG. 14 is a partial sectional view of the rope resistance mechanism shown in FIG. 13 in an open position.

It is contemplated that user 25 may add weights to the seat assembly to increase the load user 25 must lift. Alternatively, the mechanical advantage of the pulley assemblies may be decreased or a resistance mechanism 55 may be placed in mechanical communication with rope 23. Resistance mechanism 55 provides resistance to the movement of rope 23 when pulled by user 25 and the amount of resistance is adjusted by rotation of handle 59. As shown in FIG. 13, mechanism 55 includes handle 59 and attached linkage 61 pivotally connected 60 to frame 16. Linkage 61 is in turn connected to bearing member 62, which communicates with compression block 56 by wheel 72. Compression block 56 includes upper clamping element 56*a* and generally opposed fixed lower element 56*b* defining a channel 58 therebetween through which rope 23 extends. As shown in FIGS. 13-14, rotation of handle 59 in a counterclockwise direction causes opposed member 56*a* to move towards member 56*b* and thereby compress rope 23. In particular, upper clamping element 56*a* is tapered and configured to move a few inches horizontally. When a sufficient downward force is applied to end portion 30 of rope 23 such that rope 23 moves to the right, upper clamping element 56*a* is pulled into wheel 72, narrow end first, thus wedging itself against rope 23. This restricts the movement of rope 23 such that greater force must be applied to rope 23 to move seat 18. When rope 23 is released or user 25 descends, and rope 23 thereby moves to the left, because of its taper upper clamping element 56*a* slides away from wheel 72, thus eliminating the resistance on rope 23.

When handle 59 is moved to the position shown in FIG. 14, element 56*a* separates from opposed element 56*b*, thereby enlarging channel 58 and allowing rope 23 to slide in channel 58 with limited if any frictional contact with clamping elements 56*a* and 56*b*. Clamping elements 56*a* and 56*b* may be dimensioned such that, when handle 59 is rotated counterclockwise to the position shown in FIG. 13, rope 23 can be locked by clamping elements 56*a* and 56*b* so that it is not able to slide in channel 58. Increments between fully open and fully closed are also provided so that the amount of resistance can be selected by user 25.

The present invention contemplates that many changes and modifications may be made. Therefore, while the presently-preferred form of the rope climbing apparatus has been shown and described, and a number of alternatives discussed, persons skilled in this art will readily appreciate that various additional changes and modifications may be made without departing from the spirit of the invention, as defined and differentiated by the following claims.

What is claimed is:

1. A rope climbing apparatus comprising:

a frame;

a seat supported by said frame and adapted to move relative to said frame from a first position to an elevated second position;

a lower pulley assembly connected to said seat;

an upper pulley assembly connected to said frame;

a rope extending between said lower pulley assembly and said upper pulley assembly and having a rope climbing portion graspable by a user when said user is seated on said seat;

said rope, said seat, said lower pulley assembly and said upper pulley assembly configured and arranged such that a downward force on said rope climbing portion of said rope causes an upward force on said seat;

a seat decent control configured and arranged to control a rate of decent of said seat from said second elevated position to said first position;

said seat control comprising a tube housing a piston, said piston movable within said tube between a first position and an elevated second position, and a control rope connected to said movable piston at a first end and extending from said first end down and under a control pulley connected to said seat and connecting to said frame at a second end;

said control pulley, said tube, said piston and said control rope configured and arranged such that said piston moves from said first position to said elevated second position when said seat moves from said elevated second position to said first position, whereby resistance to said piston moving within said tube from said first position to said elevated second position limits said rate of descent of said seat from said second elevated position to said first position.

2. The rope climbing apparatus set forth in claim 1, wherein said downward force on said rope climbing portion results in an upward force on said seat at a mechanical advantage provided by said lower pulley assembly and said upper pulley assembly.

3. The rope climbing apparatus set forth in claim 2, wherein said mechanical advantage is four.

4. The rope climbing apparatus set forth in claim 1, wherein said rope comprises a first end portion connected to said seat.

5. The rope climbing apparatus set forth in claim 4, wherein said rope climbing portion comprises a second end portion within grasp of said user when said user is seated on said seat.

6. The rope climbing apparatus set forth in claim 1, wherein said lower pulley assembly comprises two pulleys rotatable about a lower axis of rotation, said upper pulley assembly comprises three pulleys rotatable about an upper axis of rotation, and said rope extends between said pulleys in said upper pulley assembly and said pulleys in said lower pulley assembly to form a compound pulley system.

7. The rope climbing apparatus set forth in claim 6, wherein said rope comprises a first end portion connected to said lower assembly and extends from said first end portion up and over said first pulley in said upper pulley assembly, down and under said first pulley in said lower pulley assembly, up and over said second pulley in said upper pulley assembly, down and under said second pulley in said lower pulley assembly, and up and over said third pulley in said upper pulley assembly.

8. The rope climbing apparatus set forth in claim 7, wherein said rope extends over a sixth pulley above said seat and terminates at a second end portion within grasp of said user when said user is seated on said seat.

9. The rope climbing apparatus set forth in claim 1, wherein said control rope is wire cable.

10. The rope climbing apparatus set forth in claim 1, and further comprising a resistance mechanism in mechanical communication with said rope for selectively providing resistance to movement of said rope.

11. The rope climbing apparatus set forth in claim 10, wherein said resistance mechanism comprises a handle connected to a compression member adapted to frictionally engage said rope, said handle and said compression member configured and arranged to selectively restrict movement of said rope past said compression member.

* * * * *